US008590888B2

(12) United States Patent
Desire

(10) Patent No.: US 8,590,888 B2
(45) Date of Patent: Nov. 26, 2013

(54) DEVICE FOR STORING MAILPIECES

(75) Inventor: Régis Desire, Sceaux (FR)

(73) Assignee: Neopost Technologies, Bagneux (FR)

( * ) Notice: Subject to any disclaimer, the term of this patent is extended or adjusted under 35 U.S.C. 154(b) by 326 days.

(21) Appl. No.: 13/023,115

(22) Filed: Feb. 8, 2011

(65) Prior Publication Data

US 2011/0204068 A1 Aug. 25, 2011

(30) Foreign Application Priority Data

Feb. 23, 2010 (EP) ..... 10305173

(51) Int. Cl.
*B65H 31/00* (2006.01)

(52) U.S. Cl.
USPC ..... 271/207; 271/2; 271/224

(58) Field of Classification Search
USPC ..... 271/2, 207, 224
See application file for complete search history.

(56) References Cited

U.S. PATENT DOCUMENTS

| | | | | |
|---|---|---|---|---|
| 5,332,210 | A * | 7/1994 | Silverberg et al. | 271/220 |
| 6,250,629 | B1 * | 6/2001 | Brown et al. | 271/220 |
| 6,390,702 | B1 * | 5/2002 | Muller | 400/636 |
| 6,585,249 | B1 * | 7/2003 | Andreyka et al. | 271/2 |
| 6,634,639 | B2 * | 10/2003 | Kuroda et al. | 271/178 |
| 2003/0042169 | A1 | 3/2003 | Caporali et al. | |
| 2005/0017439 | A1 * | 1/2005 | Luquet et al. | 271/207 |
| 2008/0122164 | A1 | 5/2008 | Sparer et al. | |
| 2012/0193866 | A1 * | 8/2012 | Bernard et al. | 271/207 |

FOREIGN PATENT DOCUMENTS

| | | | |
|---|---|---|---|
| EP | 1 443 008 | A1 | 8/2004 |
| EP | 1 609 730 | A1 | 12/2005 |
| GB | 2 195 312 | A | 4/1988 |
| JP | 51-65633 | U | 5/1976 |
| JP | 53-51244 | U | 5/1978 |
| JP | 4-72264 | A | 3/1992 |
| JP | 2002-234659 | A | 8/2002 |

* cited by examiner

*Primary Examiner* — Kaitlin Joerger
(74) *Attorney, Agent, or Firm* — Sughrue Mion, PLLC

(57) ABSTRACT

A storage device for a franking machine, which storage device comprises: a receptacle for receiving mailpieces ejected one-by-one by the franking machine; a longitudinal referencing wall extending over a longitudinal edge of the receptacle and against which the mailpieces rebound before they accumulate on the receptacle; and a vertical back wall extending along a side edge of the receptacle and that the mailpieces hit before they rebound against the longitudinal referencing wall; the vertical back wall forming an angle β with a perpendicular to the longitudinal referencing wall; and the receptacle being inclined relative to the horizontal and towards the longitudinal referencing wall at an angle ϕ so that the angle α between the receptacle and the longitudinal referencing wall forms an acute angle.

8 Claims, 2 Drawing Sheets

DEVICE FOR STORING MAILPIECES

FIELD OF THE INVENTION

The present invention relates to the field of mail handling, and it relates more particularly to a storage device or "drop stacker" for a franking machine or "postage meter".

PRIOR ART

Current franking machines are increasingly fast, and, in order to keep up with such high-speed franking, it is necessary to increase their feed and storage capacities so as to avoid the need for operators to be constantly loading and unloading the machines. However, such an increase in feed and storage capacity should not be achieved to the detriment of the space occupied by the franking machine or to the detriment of control by its operator.

Although this problem can be solved simply for feeder devices in which mailpieces are disposed in a vertical stack, and in which increasing the height of the stack does not give rise to any modification in the footprint of the module, the same does not apply to storage devices in which the same mailpieces are, in conventional manner, stored horizontally and in which any increase in the number of mailpieces stored in this way necessarily involves an increase in the area used for storage.

In Application EP 1 443 008, the Applicant proposes a storage device of particularly simple structure enabling mailpieces to accumulate while flat, and offering relatively large storage capacity because it is disposed below the level of the franking machine. However, that storage solution by accumulation while flat is not fully satisfactory because it is not guaranteed to operate properly for mailpieces that are of a variety of formats and that are difficult to hold in place. In addition, the speed of ejection of the mailpieces (of identical formats) in a fast machine gives rise to uncontrolled rebounding that, at best, results in a non-uniform stack being formed.

OBJECT AND SUMMARY OF THE INVENTION

The present invention proposes to mitigate the above-mentioned drawbacks with a storage device for a franking machine that comprises:

- a receptacle for receiving mailpieces ejected one-by-one via an outlet slot of said franking machine;
- a longitudinal referencing wall extending over a longitudinal edge of said receptacle perpendicularly to said outlet slot and against which said mailpieces rebound before they accumulate on said receptacle; and
- a vertical back wall extending along a side edge of said receptacle and that the mailpieces hit before they rebound against the longitudinal referencing wall;

said vertical back wall forming an angle $\beta$ with a perpendicular to said longitudinal reference wall; and said receptacle being inclined relative to the horizontal and towards said longitudinal referencing wall at an angle $\phi$ so that the angle $\alpha$ between said receptacle and said longitudinal referencing wall forms an acute angle.

Thus, by means of this double inclination and of the acute angle formed between the receptacle and the longitudinal referencing wall, it is possible to accumulate a large number of mailpieces rapidly by forming a uniformly jogged stack.

Preferably, said longitudinal referencing wall is inclined relative to the vertical and towards said mailpiece-receiving plate at an angle $\Delta$, said angle $\Delta$ lying in the range 0.3° to 2.5°, and being typically 1.31°.

Advantageously, said angle $\phi$ lies in the range 3° to 43°, and is typically 23°, and said angle $\beta$ lies in the range 1.30° to 5.30°, and is typically 3.30°.

Preferably, the storage device further comprises a vertical front wall that is secured to a clamp designed to be fastened to an edge of a support table for supporting said franking machine, and said receptacle is provided with a groove formed along said vertical back wall in order to enable franked mailpieces to be taken hold of.

BRIEF DESCRIPTION OF THE DRAWINGS

Other characteristics and advantages of the present invention appear more clearly from the following description given by way of non-limiting indication and with reference to the accompanying drawings, in which.

DESCRIPTION OF EMBODIMENTS

Figure 1:
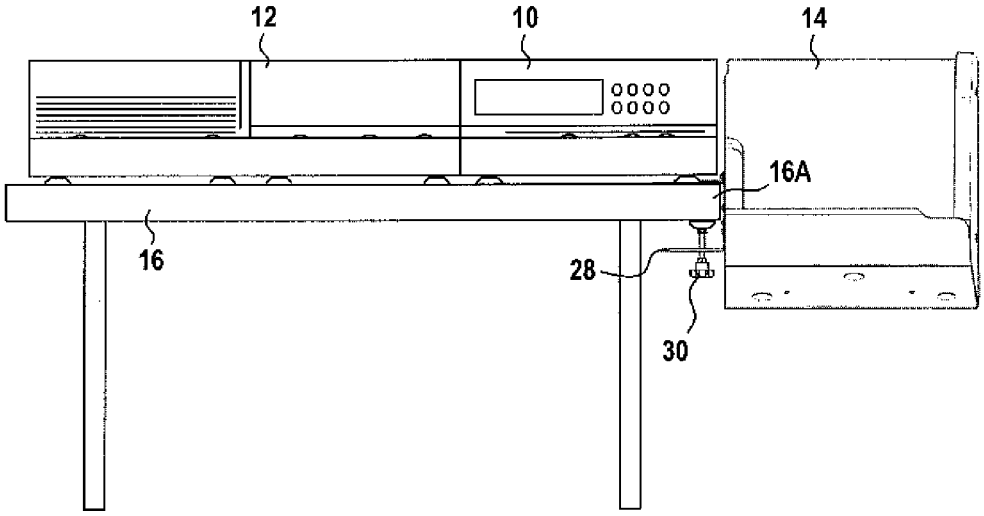
FIG. 1 is a view of a franking line including a storage device of the invention.

FIG. 1 shows a mailpiece-franking line as it commonly appears in a mail department of a private business or of a public authority, with a franking machine 10 preceded by a mailpiece feed device 12 and followed by a storage device 14 for storing the franked mailpieces. The feed device and the franking machine are conventionally disposed on a support table 16 so as to be at a level convenient for the operator of the machine, the storage device being placed at a lower level so as to enable the franked mailpieces to accumulate.

Figure 2A:
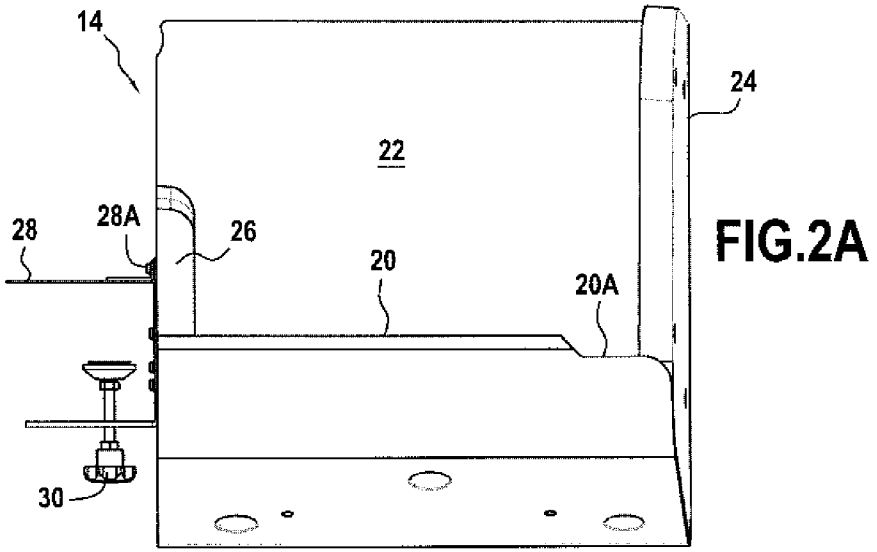
FIGS. 2A, 2B, and 2C are respectively a face view, an end view, and a plan view of the storage device of FIG. 1.
Figure 2C:
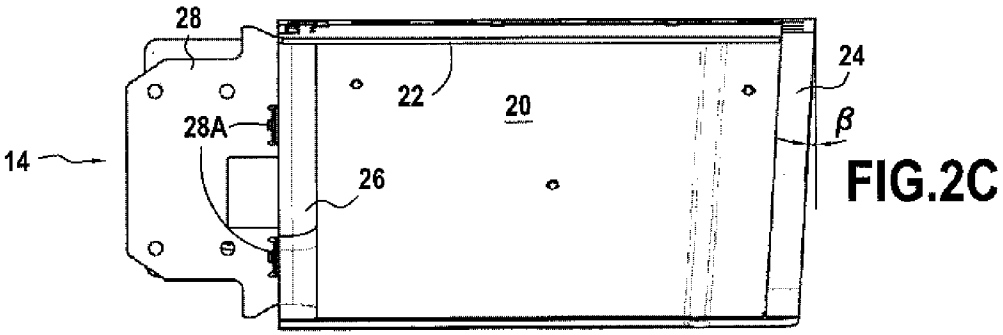
Figure 2B:
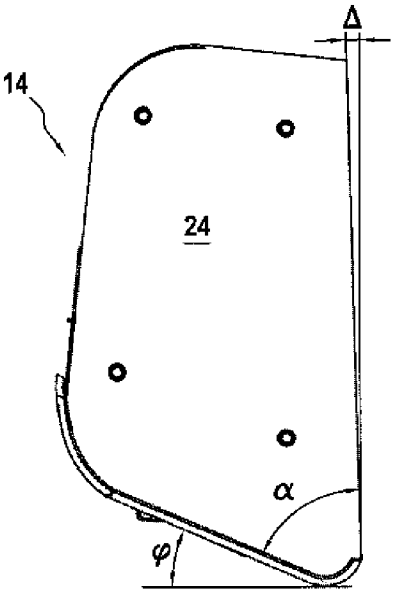

In accordance with the invention and as shown in FIGS. 2A to 2C, the storage device comprises a receptacle 20 that is substantially rectangular, a longitudinal referencing wall 22 disposed on a longitudinal edge of said receptacle and a vertical back or end wall 24 disposed on a side edge of said receptacle. The receptacle is inclined relative to the horizontal and towards the longitudinal referencing wall at an angle $\phi$ lying in the range 3° to 43°, and typically 23°. The longitudinal referencing wall is itself inclined relative to the vertical and towards the receptacle at an angle $\Delta$ lying in the range 0.3° to 2.5°, and typically 1.31° so that the angle $\alpha$ between the longitudinal referencing wall and the receptacle forms an acute angle of less than 90° and typically of about 65°. The end wall forms an angle $\beta$ with a perpendicular to the longitudinal referencing wall that lies in the range 1.30° to 5.30°, and that is typically 3.30°.

The inclination of the receptacle 20 towards the longitudinal referencing wall 22 is necessary for compensating for the natural inclination due to the thickness of the flaps that, while the mailpieces are accumulating in the device would tend to cause said mailpieces to fall off the side further from the longitudinal referencing wall. The inventor has been able to determine that an inclination of 23° is entirely appropriate for a storage device making it possible to accumulate a stack of 60 mailpieces, while an inclination of 43° is more appropriate for a stack that can receive up to 600 superposed mailpieces.

Similarly, the inclination of the vertical back wall 24 makes it possible to improve the alignment of the mailpieces because, in the absence of such inclination (i.e. with a wall exactly perpendicular to the longitudinal referencing wall), it is not possible to foresee how the mailpieces will rebound because they are never ejected in exactly parallel manner from the franking machine, and they can then just as easily rebound against the longitudinal referencing wall as in the opposite direction towards the outside of the device. A small inclination, merely of a few degrees, by guaranteeing that the first contact will almost systematically be contact at a point with the front right corner of each mailpiece, makes it possible to guarantee every time that the mailpiece will rebound towards the longitudinal referencing wall 22. In addition, such contact at a point (rather than with the entire edge of the mailpiece) tends to slow the mailpiece down and to ensure that it rebounds to a lesser extent.

The inventor has observed that the slowdown obtained by this double inclination both of the receptacle and of the actual vertical end wall can be further improved after the mailpiece has rebounded against the longitudinal referencing wall by inclining said longitudinal referencing wall towards the receptacle at a very small angle of inclination. Thus, this triple inclination makes it possible to obtain a storage device that provides particularly high performance and that accepts all formats of mailpiece.

In order to align the storage device with the franking machine, and more particularly with its outlet slot via which the mailpieces are ejected one-by-one, the storage device also has, on its front side edge, a vertical wall 26 that is secured by fasteners 28A to a clamp 28 that can be fastened to an edge 16A of the support table by a presser screw 30 passing through said clamp, in the manner in which a clamp-on vise is fastened to a workbench.

In addition, in order to facilitate taking hold of the franked mailpieces, the receptacle has a difference in level forming a groove 20A running along the vertical back face 24 of the device.

What is claimed is:

1. A storage device for a franking machine, which storage device comprises:

a receptacle for receiving mailpieces ejected one-by-one via an outlet slot of said franking machine;

a longitudinal referencing wall extending over a longitudinal edge of said receptacle perpendicularly to said outlet slot and against which said mailpieces rebound before° they accumulate on said receptacle; and a vertical back wall extending along a side edge of said receptacle and that the mailpieces hit before they rebound against the longitudinal referencing wall;

said vertical back wall forming an angle $\beta$ with a perpendicular to said longitudinal referencing wall; and said receptacle being inclined relative to the horizontal at an angle $\phi$ and inclined towards said longitudinal referencing wall so that the angle $\alpha$ between said receptacle and said longitudinal referencing wall forms an acute angle of less than 90°.

2. A storage device according to claim 1, wherein said longitudinal referencing wall is inclined relative to the vertical and towards said receptacle at an angle $\Delta$.

3. A storage device according to claim 2, wherein said angle $\Delta$ lies in the range 0.3° to 2.5°, and is typically 1.31°.

4. A storage device according to claim 1, wherein said angle $\phi$ lies in the range 3° to 43°, and is typically 23°.

5. A storage device according to claim 1, wherein said angle $\beta$ lies in the range 1.30° to 5.30°, and is typically 3.30°.

6. A storage device according to claim 1, further comprising a vertical front wall that is secured to a clamp designed to be fastened to an edge of a support table for supporting said franking machine.

7. A storage device according to claim 1, wherein said receptacle is provided with a groove formed along said vertical back wall in order to enable franked mailpieces to be taken hold of.

8. A storage device according to claim 1, wherein said acute angle $\alpha$ is about 65°.

* * * * *